US006030185A

United States Patent [19]

Feigel et al.

[11] Patent Number: 6,030,185

[45] Date of Patent: Feb. 29, 2000

[54] RADIAL PISTON PUMP

[75] Inventors: Hans-Jörg Feigel, Rosbach; Lothar Schiel, Hofheim; Ulrich Neumann, Rossdorf, all of Germany

[73] Assignee: ITT Manufacturing Enterprises Inc., Wilmington, Del.

[21] Appl. No.: 09/000,439

[22] PCT Filed: Jul. 11, 1996

[86] PCT No.: PCT/EP96/03028

§ 371 Date: Mar. 16, 1998

§ 102(e) Date: Mar. 16, 1998

[87] PCT Pub. No.: WO97/05381

PCT Pub. Date: Feb. 13, 1997

[51] Int. Cl.[7] ..... F04B 1/04

[52] U.S. Cl. ..... 417/273; 417/216; 417/270; 417/273; 417/521; 417/523; 417/540; 91/481; 91/490; 91/492; 91/493; 91/497; 92/12.1; 92/121; 418/37; 418/138; 418/144; 418/186

[58] Field of Search ..... 417/216, 270, 417/273, 462, 471, 523, 540, 534, 521; 91/481, 492, 497, 490, 493; 92/12.1, 121; 60/447; 418/37, 138, 144, 186

[56] References Cited

U.S. PATENT DOCUMENTS

| | | | |
|---|---|---|---|
| 3,000,319 | 9/1961 | Tuck . | |
| 3,767,331 | 10/1973 | Klesatschke | 418/37 |
| 3,828,400 | 8/1974 | Mason et al. | 91/497 |
| 3,913,456 | 10/1975 | Bosch | 91/497 |
| 3,982,855 | 9/1976 | Adlinger et al. | 417/270 |
| 4,139,988 | 2/1979 | Adachi . | |
| 4,453,898 | 6/1984 | Leka et al. | 417/521 |
| 4,673,337 | 6/1987 | Miller | 417/273 |
| 4,711,616 | 12/1987 | Tsukahara et al. | 417/216 |
| 5,095,599 | 3/1992 | Budecker | 417/534 |
| 5,213,482 | 5/1993 | Reinartz et al. | 417/273 |
| 5,244,356 | 9/1993 | Hasegawa | 417/273 |
| 5,547,348 | 8/1996 | Riley et al. | 417/273 |
| 5,626,466 | 5/1997 | Ruoff et al. | 417/273 |
| 5,944,493 | 8/1999 | Albertin et al. | 417/273 |

FOREIGN PATENT DOCUMENTS

| | | |
|---|---|---|
| 0081927 | 11/1989 | European Pat. Off. . |
| 656076 | 4/1929 | France . |
| 3935117 | of 0000 | Germany . |
| 4401074 | of 0000 | Germany . |
| 7111897 | of 0000 | Germany . |
| 1001593 | 11/1957 | Germany . |
| 1553976 | 1/1969 | Germany . |
| 1919881 | 11/1969 | Germany . |
| 3520338 | 6/1985 | Germany . |
| 3510633 | 10/1985 | Germany . |
| 3504163 | 8/1986 | Germany . |
| 3512696 | 10/1986 | Germany . |
| 4123380 | 1/1993 | Germany . |
| 2254316 | 5/1994 | Germany . |
| 4301287 | 7/1994 | Germany . |

*Primary Examiner*—John A. Jeffery
*Assistant Examiner*—L. Fastovsky
*Attorney, Agent, or Firm*—Radar, Fishman & Grauer PLLC

[57] ABSTRACT

The present invention relates to a pump, more particularly a radial piston pump, including at least two pump pistons (10) with an associated working chamber (13) each, wherein the working chambers (13) are connected to suction lines (4) by way of suction valve devices (8) and to a joint pressure line (5) by way of pressure valve devices (9), wherein at least one of the suction valve devices (8) opens during the pressure stroke in dependence on the pressure in one of the associated lines (4, 5), and wherein at least one of the suction valve devices (8) opens during the pressure stroke in dependence on the pressure in the pressure line (5).

6 Claims, 2 Drawing Sheets

RADIAL PISTON PUMP

BACKGROUND OF THE INVENTION

The present invention relates to a pump including at least two pump pistons with an associated working chamber each, the working chambers being connected to suction lines by way of suction valve devices and to a joint pressure line by way of pressure valve devices.

German patent application No. 35 10 633, for example, discloses a pump of this type. This publication shows a piston pump having several cylinder-and-piston assemblies, one of which is intended to provide the suction lines of the other cylinder-and-piston assemblies with pressurized fluid. The suction valve devices of the individual cylinder-and-piston assemblies include preloaded non-return valves which will not open until a minimum pressure prevails in the suction line. In the absence of this minimum pressure, the piston cannot aspirate pressure fluid and remains in its inactive position, i.e., it does not abut on the eccentric driving it.

A disadvantage of the prior art piston pump is that it requires a pilot pressure on the suction side, to what end at least one further cylinder-and-piston assembly is required. The maximum volume flow of the pump is limited by the rate of delivery of the cylinder-and-piston assembly.

An object of the present invention is to provide a pump which is in a position to supply a great volume flow and to temporarily deactivate one or more of its cylinder-and-piston assemblies, in response to requirements.

SUMMARY OF THE INVENTION

This object is achieved, according to the present invention, in that at least two of the suction valve devices open in dependence on the pressure in the pressure line. Therefore, no pilot pressure is required in the suction lines, i.e., none of the pistons has to be employed as a backing pump, and the volume flow is not limited by the delivery rate of a backing pump. Opening of the suction valve device corresponds to the neutral position of the associated piston, i.e., a smaller volume flow and a lower power consumption of the pump. As long as the consumer has a high volume requirement, the pressure in the pressure line is low, and the suction valve device remains closed during the pressure stroke. When the pressure in the pressure line exceeds a defined switching pressure, the suction valve device will open also during the pressure stroke, and the pressure fluid can be returned almost unpressurized from the working chamber into the suction line. Only friction losses will occur, the power consumption of the pump is low. The arrangement of the present invention can be used especially favorably in radial piston pumps having pistons which are coupled to the eccentric and, therefore, cannot remain immovable in an inactive position as is possible in the pump known from prior art.

Favorably, the suction valve device is opened by compulsory control. This opening can be effected by an electromagnetically operable valve, for example, which is actuated by appropriate pressure-sensing and controlling devices. Favorably, it is also possible to perform the mentioned compulsory control hydraulically. To this end, an actuating member may be provided which can be acted upon by the pressure in the pressure line, on the one hand, and can act on a closure member of the suction valve device in the opening direction, on the other hand.

According to the present invention, a closure member of this type is coupled to a control piston which is connected to the pressure line, on the one hand, and to the suction line, on the other hand. In this case, the suction line acts as a damping chamber to smoothen pressure pulsations which occur in the pressure line.

When several suction valve devices are opened in response to the pressure in the pressure line, and the switching pressure values have a different magnitude, the associated pump pistons can be deactivated one after the other. To this effect, the switching pressures are graded, for example, equidistantly or in any other grading which is conformed to the volume flow requirement or the pressure requirement of the consumer. This permits reducing the power consumption of the pump and, additionally, optimizing it to the requirement of the connected consumer because in each case only so many pump pistons are in operation as are required to maintain the necessary volume flow or the necessary pressure.

A simple possibility of adjusting the different switching pressures involves that the spring elements of the suction valve devices have varying spring rates or are preloaded to a different extent.

Advantageously, the pump of the present invention is used as a pressure fluid source in automotive vehicle auxiliary pressure systems, in particular, for hydraulic steering servo units, brake force boosters or electronically driven independent force brake systems, such as anti-lock system, traction slip control system, driving stability control system or a system for actuating the brake system irrespective of the driver. In systems of this type, frequently, a volume-flow/pressure characteristic curve is desired which can be adjusted by the pump of the present invention. Of course, this does not make the pumps inappropriate for other cases of application.

Further advantages of the present invention can be seen in the following description, making reference to the accompanying drawings.

DETAILED DESCRIPTION OF THE DRAWINGS

Figure 1:
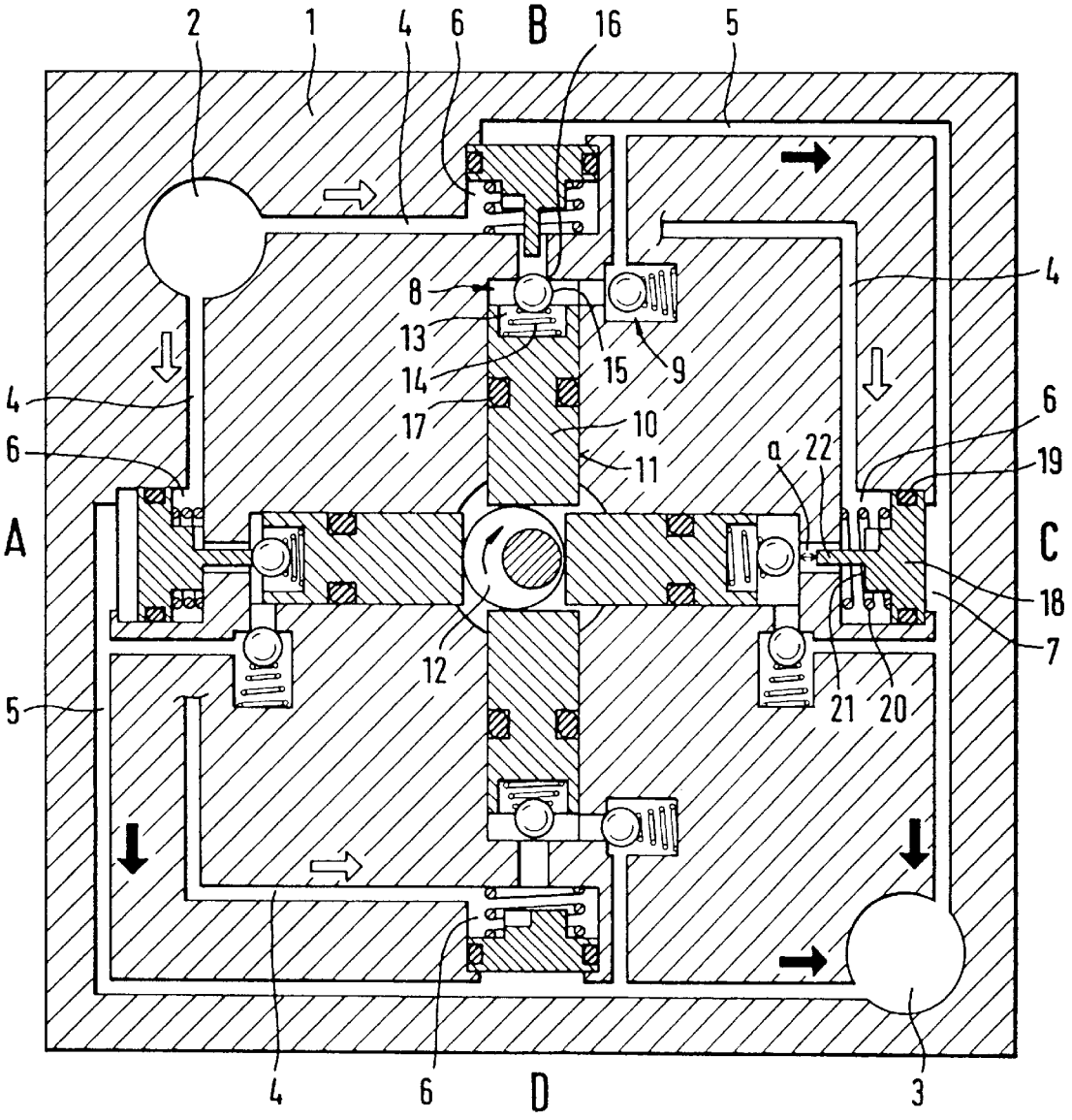
FIG. 1 is a schematic view of a pump of the present invention including four pump pistons.

FIG. 1 shows a schematic view of a cross-section taken through the housing 1 of a pump according to the present invention. Housing 1 accommodates a suction port 2 and a pressure port 3. Suction lines 4 lead to suction valve devices 8 of the pump pistons 10 by way of prechambers 6. The pump pistons 10 are guided in bores 11 and driven by an eccentric. The end of the pump pistons 10 remote from the eccentric 12 limits a working chamber 13 which is connected to the prechamber 6 by way of the suction valve device 8, that is comprised of spring 14, closure member 15 and valve seat 16. The working chamber 13 is connected to the pressure line 5 by way of a pressure valve device 9.

The pump pistons 10 are sealed relative to the bore 11 by sealing elements 17. Damping chambers 7 are arranged in the pressure line 5 close to the pressure valve devices 9. The damping chambers 7 are confined by a movable control piston 18 which is slidable in the prechamber 6 and sealed by a sealing element 19. Further, a spring element 20 is positioned in the prechamber 6 and preloads the control piston 18 into its inactive position close to the damping chamber. A stop 21 limits the possible stroke of the control piston 18 in the position remote from its inactive position. Further, the control piston 18 has an actuating member 22 which removes the closure member 15 of the suction valve device 8 from its valve seat 16 in the actuated position of the control piston 18 (see side A in FIG. 1). The working chamber 13 is thereby connected to the suction line 4. This forced opening of the suction valve device 8 takes place after the control piston 18 has covered a lost travel 'a'.

Operation of the pump

The eccentric 12 performs an eccentric movement and displaces the pump pistons 10 in a radial direction with respect to the eccentric 12. As long as the pump piston 10 is moved radially inwardly, the volume of the working chamber 13 increases, the suction valve device 8 is open, and pressure fluid is conducted from the suction line 4 to the working chamber 13 (see e.g. side D in FIG. 1). When the pump piston 10 has reached its bottom dead center (see side C in FIG. 1), the working chamber 13 has reached its maximum volume. Now, the pressure stroke starts. When it commences, the suction valve device 8 closes and the pressure valve device 9 opens (see side B in FIG. 1). The pressure fluid is now urged under pressure out of the working chamber 13 into the pressure line 5. Thereby, the pressure in the damping chamber 7 also rises, with the result that the control piston 18 is displaced from its inactive position as soon as the force exerted on it on the damping chamber side exceeds the resetting force of the spring element 20. The control piston 18 yields, whereby pressure pulsations in the pressure line 5 are smoothened.

When the pressure in the pressure line 5 is so high that the control piston 18 moves until it abuts on its stop remote from the damping chamber 7, the actuating member 22 will open the associated suction valve device 8. This causes the corresponding piston to be connected (i.e. short-circuited) to the suction line 4 in each of its working positions, i.e., during the pressure stroke as well. This means, the piston idles (side A in FIG. 1). The piston now contributes neither to the increase of the volume flow nor to the power consumption of the pump.

The spring rates of the spring elements 20 have different amounts so that the switching pressures necessary for the compulsory opening of the corresponding suction valve devices 8 are differently rated. For example, the control piston 18 on side A in FIG. 1 reaches its final position already at a pressure $p_1$ which is lower than the pressure $p_2$. At pressure $p_2$, the control piston 18 reaches its final position on side C in FIG. 1. The control pressure $p_2$, in turn, is lower than the control pressure $p_3$ at which the control valve device 8 on side B in FIG. 1 is opened. At least one of the pump pistons 10, on side D in FIG. 1, has no actuating member 22 and, thus, contributes to the volume flow and the pressure build-up in the pressure line 5 at any time.

The lost travel 'a' of the control pistons 18 is dimensioned so that a pressure pulsation compensation is possible without the need for a simultaneous forced opening of the control valve device 8.

Figure 2:
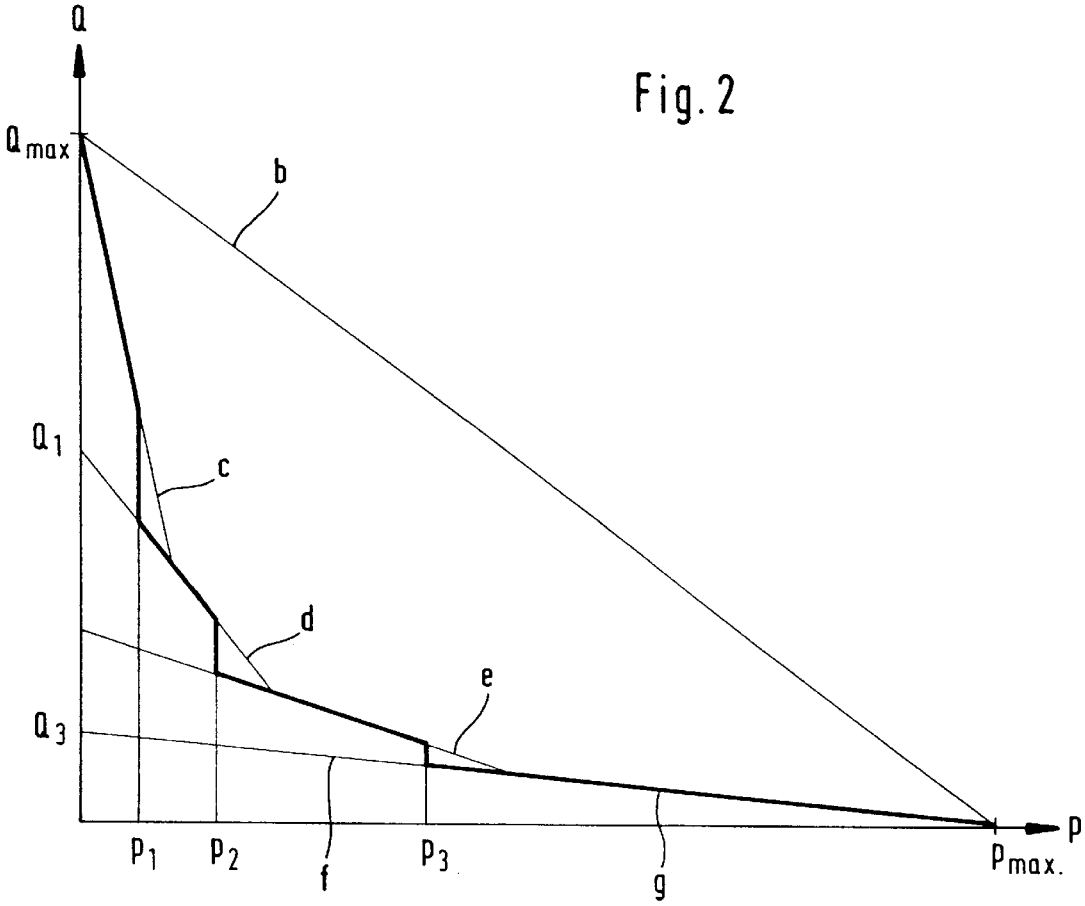
FIG. 2 is a pump characteristic curve of a pump of the present invention.

FIG. 2 shows a pump characteristic curve of a pump of the present invention. Volume flow Q is plotted as a function of the hydraulic pressure p. The top line b represents the characteristic curve of a conventional pump, the requirement of which is to generate both a maximum volume flow $Q_{max}$ and a maximum pressure $p_{max}$. The line c shows the characteristic curve of the pump of the present invention with all four pistons in operation. At a switching pressure $p_1$, a pump piston 10 (on side A in FIG. 1) is deactivated which corresponds to the pump characteristic curve d in FIG. 2. The maximum possible volume flow $Q_1$ in this case is substantially lower than $Q_{max}$, and the maximum possible pressure p is below the necessary maximum pressure $p_{max}$. When the switching pressure $p_2$ is reached, another pump piston 10 is switched to the idle position (side C in FIG. 1), with the result of the pump characteristic e. When the pressure p in the pressure line 5 exceeds the switching pressure $p_3$, the third pump piston 10 (side B in FIG. 1) is switched to the idle position so that the pump characteristic curve f in FIG. 2 is adopted. Because only one pump piston 10 still delivers fluid in this case, the theoretic volume flow $Q_3$ is much lower than $Q_{max}$, and the maximum attainable hydraulic pressure $P_{max}$ corresponds to the requirements set. The bold-face type drawn pump characteristic curve g results for the pump of the present invention due to the individual switching operations.

Preferably, the pump of the present invention is driven electrically and can be used for a brake force booster or a steering servo unit, for example, without a pressure accumulator. Due to the special design of a typical pressure-volume characteristic curve g, especially in an automotive vehicle brake system, and the actuation ability of the driver of an automotive vehicle, the auxiliary pressure generator is required to produce a very high volume flow at a low load pressure (pump characteristic curve c) in a first phase of braking and a high pump pressure at low volume flow (pump characteristic g) in a second phase. These extreme requirements necessitate that the electric motor driving the pump must be dimensioned to have high performance values and great inertia moments in addition. This problem can be overcome by varying the delivery volume Q pressure-responsively. In contrast to conventional variable-displacement pumps known from prior art, the pump of the present invention offers a solution for application in automotive vehicles which can be realized at substantially reduced costs. It is shown in FIG. 1 that the pressure-side damping chamber 7 accommodates the control piston 18 configured as a damping piston. Control piston 18, in turn, cooperates with a spring element 20 which permits dampening pressure peaks, on the one hand, and keeping the suction valve device 8 open after a constructively predefined pressure level is reached, on the other hand.

We claim:

1. A pump including at least two pump pistons with an associated working chamber each, the pump pistons performing pressure strokes alternating with suction strokes, wherein the working chambers each are connected to suction lines by way of a suction valve device each and to a joint pressure line by way of a pressure valve device each, and wherein at least two of the suction valve devices open during the pressure strokes of the pump pistons associated with the respective working chambers in dependence on the pressure in the pressure line, these at least two suction valves each being operable by a control piston exposable to the pressure in the pressure line and to the pressure in the respective suction line, and the control pistons being preloaded by differently rated preloads.

2. A pump as claimed in claim 1, wherein the at least two suction valve devices can be opened by compulsory control.

3. A pump as claimed in claim 2, wherein the at least two suction valve devices each have a closure member which is preloaded in relation to a valve seat, and wherein associated with the closure member is an actuating member which can act upon the closure member, on the one hand, and to which the pressure in the pressure line can be applied, on the other hand.

4. A pump as claimed in claim 3, wherein the actuating member is connected to the respective control piston which is preloaded by a spring element.

5. A pump as claimed in claim 4, wherein the spring elements have different spring rates.

6. An automotive vehicle auxiliary pressure system including a pump having at least two pump pistons with an associated working chamber each, the pump pistons performing pressure strokes alternating with suction strokes, wherein the working chambers each are connected to suction lines by way of a suction valve device each and to a joint pressure line by way of a pressure valve device each, and wherein at least two of the suction valve devices open during the pressure strokes of the pump pistons associated with the respective working chambers in dependence on the pressure in the pressure line, these at least two suction valves each being operable by a control piston exposable to the pressure in the pressure line and to the pressure in the respective suction line, and the control pistons being preloaded by differently rated preloads.

* * * * *